US005362058A

United States Patent [19]

Honig

[11] Patent Number: 5,362,058

[45] Date of Patent: Nov. 8, 1994

[54] PUTTER TRAINING DEVICE

[75] Inventor: Daniel A. Honig, Palm Beach Gardens, Fla.

[73] Assignee: Fairview Products, Inc., Plam Beach, Fla.

[21] Appl. No.: 16,958

[22] Filed: Feb. 12, 1993

[51] Int. Cl.[5] ..... A63B 69/36

[52] U.S. Cl. ..... 273/186.2

[58] Field of Search ..... 273/194 A, 186.2, 187.4, 273/163 R, 163 A, 164.1, 164.2, 194 R, 194 B

[56] References Cited

U.S. PATENT DOCUMENTS

| | | | |
|---|---|---|---|
| 1,173,384 | 2/1916 | Rees | 273/164 |
| 1,651,264 | 11/1927 | Fish | 273/194 A X |
| 1,759,622 | 5/1930 | Kenney | 273/194 A |
| 2,898,109 | 8/1959 | Williams | 33/263 X |
| 3,198,525 | 8/1965 | Smith | 273/194 A |
| 3,292,928 | 12/1966 | Billen | 273/163 |
| 3,529,830 | 9/1970 | Palotsee | 273/163 |
| 3,667,761 | 6/1972 | Palotsee | 273/194 A X |
| 4,174,838 | 11/1979 | Paschetto | 273/163 A |
| 4,468,034 | 8/1984 | Duclos | 273/194 A X |
| 4,720,110 | 1/1988 | Hurst | 273/163 R X |

*Primary Examiner*—George J. Marlo

*Attorney, Agent, or Firm*—Dickinson, Wright, Moon, Van Dusen & Freeman

[57] ABSTRACT

A training device for use in conjunction with a golf club, includes a rod-like sighting element that can be removably affixed to a golf club in such a way that it extends over the front and back faces of the head of the club. The portion of the sighting element which extends past the hitting face of the club head is upwardly inclined in the direction in which the ball is to be hit. In one embodiment, the device consists of a plastic rod-like element which is attached to a base via an arm. The base is fitted with a magnet to secure it to the metal head of a putter. The arm holds the rod-like element above the head of the putter at an angle which is upwardly inclined in the direction in which the ball is to be hit.

10 Claims, 2 Drawing Sheets

FIG. 1
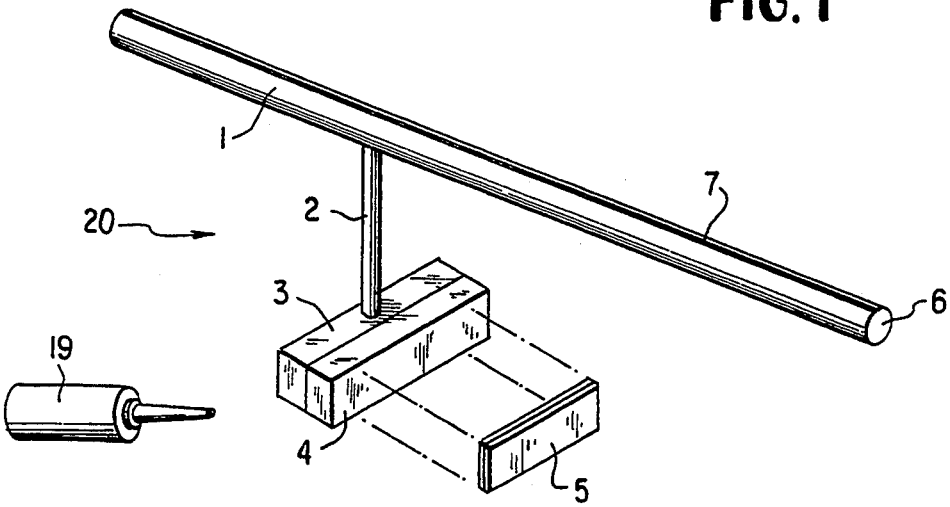
FIG. 8
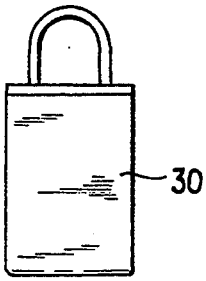
FIG. 2
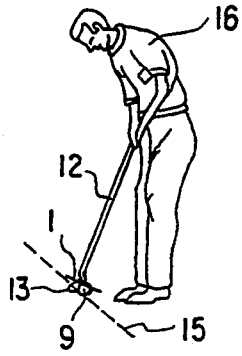
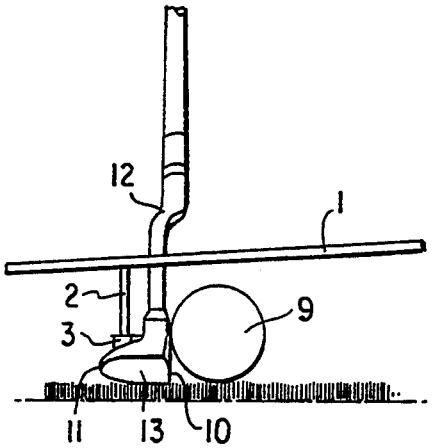
FIG. 3
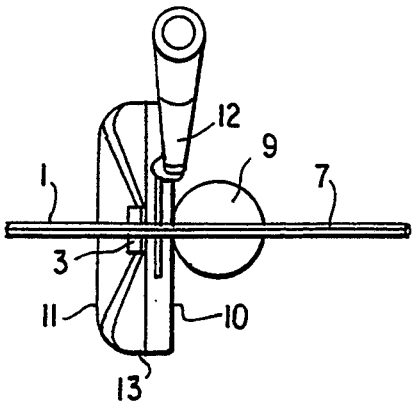
FIG. 4

PUTTER TRAINING DEVICE

FIELD OF THE INVENTION

This invention relates to a device useful for improving a golfer's stroke, line of flight, and stance, and is particularly useful for improving a golfer's putting game.

BACKGROUND OF THE INVENTION

Many devices have been proposed in the prior art which attach to golf clubs and are intended to improve a golfer's game by aiding his stroke, his stance, or the line of flight of the ball. Some of these devices require specially modified golf clubs; for example, U.S. Pat. No. 1,173,384 uses a collapsible indicator built into the club itself, while U.S. Pat. No. 3,292,928, U.S. Pat. No. 3,529,830, and U.S. Pat. No. 3,667,761 feature devices that screw or fit into apertures in the head of the club. Other devices have been constructed that fit onto any club and use mirrors as the sighting element; for example, U.S. Pat. No. 2,898,109 uses a mirror which clamps to the shaft of the club. While these devices have the advantage of being usable with any club, they tend to be cumbersome to use, costly to manufacture, or wholly ineffective.

Finally, a number of devices have been proposed which use sighting elements that can be removably affixed to either the head or the shaft of a golf club. For example, U.S. Pat. No. 4,174,838 utilizes an apparatus containing a clamping device and pendulum means for aligning the sighting element with the ball; U.S. Pat. No. 3,198,525 features a foldable sighting element which attaches to the shaft of a club; and U.S. Pat. No. 4,720,110 features a metal shank with a threaded sighting element on one end and a magnet on the other end. While these devices can be removably fitted onto any club, their sighting elements are horizontally disposed in a direction normal to the plane of the hitting face of a golf club. This arrangement is cumbersome in use because it causes the sighting element to come into contact with the ground or the ball on the forward or backward swing. When the vertical distance between the sighting element and the head of the club is increased to avoid these problems, the sighting element is less effective. U.S. Pat. No. 4,720,110 has attempted to deal with some of these problems by having the sighting element in some of its embodiments extend to the rear of the hitting face of the club. However, this arrangement is less effective in providing direction than an arrangement where the sighting element extends over both faces of the club. In addition, U.S. Pat. No. 4,720,110 calls for use of the device in conjunction with markings on the club itself.

SUMMARY OF THE INVENTION

The present invention is inexpensive, easy to manufacture, highly effective, and avoids the infirmities of the prior art.

In the present invention, the sighting element is upwardly inclined with respect to the ground in the direction from the hitting face of the club to the target. Consequently, the sighting element may be vertically disposed close to the ball without making contact with the ball on the forward swing.

Furthermore, unlike many prior art devices, the sighting element of the present invention extends over both the hitting face of the club and the rear face of the club. This improves the alignment and visualization of the stroke and the shot, and dramatically indicates to the golfer any defects in his form.

A further novel feature of the present invention is the presence of markings along the spine of the sighting element. In the preferred embodiment, these markings are in the form of a bright line along the dark cylinder of the sighting element. These markings further aid the golfer in lining up his shot.

A further novel feature of the present invention is the availability of the golfing aid in the form of a kit. This allows a user the flexibility of attaching the golfing aid to a club using any of the alternative means of fastening as the circumstances and choice of golf clubs may require. The invention contemplates kits for permanently attaching or removably attaching the device to golf clubs.

BRIEF DESCRIPTION OF THE DRAWINGS

FIG. 1 is a perspective view of a preferred embodiment of the invention, with optional magnet or hook and loop type fastener attachments;

FIG. 2 is a view illustrating the line along which the device of FIG. 1 indicates that the golfer must swing to accurately reach the target;

FIG. 3 is an elevated end view of a golf club head with the device of FIG. 1 attached to it;

FIG. 4 is a top plan view of the device of FIG. 1 mounted on a golf club;

FIG. 8 is a side view of a packaging means that may be used as part of the golf training device kit in accordance with the invention.

PREFERRED EMBODIMENTS OF THE INVENTION

Figure 5:
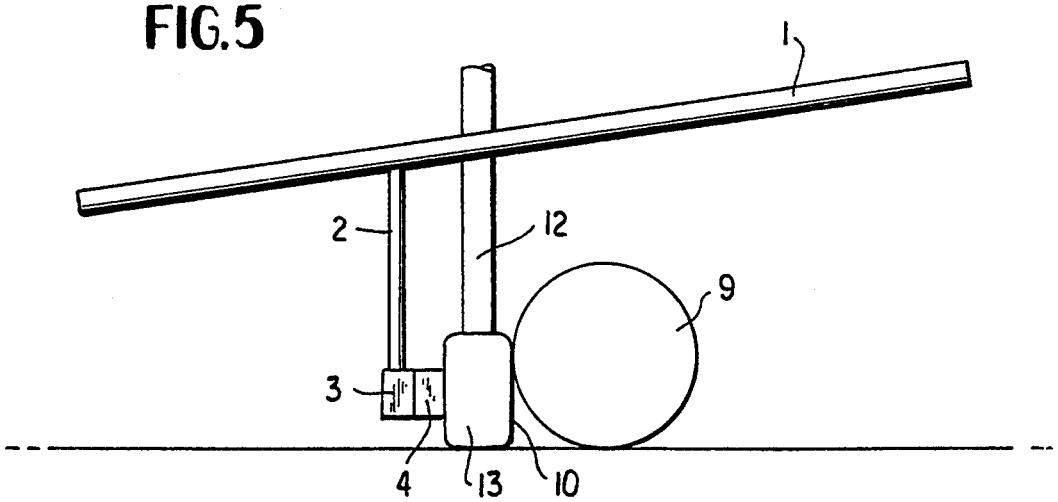
FIG. 5 is an elevated end view of a golf club head with the device of FIG. 1 removably attached to it with a magnet.

FIG. 1 shows an elevated side view of the device 20 by itself. In the preferred embodiment, the sighting element 1 is attached by an arm 2 to a base 3. The base 3, in turn, is attached to the head of a club by a magnet 4. An optional hook and loop type fastener attachment 5 is shown off to the side. The hook and loop type fastener attachment 5 is shown in FIG. 1 as consisting of two congruent, pressure sensitive adhesive strips of a hook and loop type fastener material. The strips have removable backing. When the hook and loop type fastener is used, one of the strips is attached to the magnet 4 or the base 3 and the other strip is attached to the head of the club. However, the present invention contemplates the optional use of any suitable arrangement of one or more strips of a hook and loop type fastener as a means of attaching the device 20 to the head or shaft of a golf club. It is to be understood that any other suitable means of removably fixing the device to the head or shaft of a golf club may also be used.

As FIG. 1 demonstrates, in the preferred embodiment the sighting element 1 is angularly positioned with respect to the arm 2 of the device 20 by an angle 8 that is preferably within the range of 91–135 degrees. The preferred angle is 98 degrees.

FIG. 1 also shows the end face 6 of the sighting element 1. An important feature of the sighting element is that it is rod-shaped. This feature vividly indicates the line along which the club is to be swung and the direction in which the ball is to be hit. Though the sighting element 1 preferably has a uniform circular or oval cross section, other suitable shapes are contemplated. Some examples of suitable cross section shapes include, but are not limited to, ellipses, rectangles, and polygons. Also, the cross section of the sighting element need not be uniform: thus, for example, the sighting element 1 may be tapered at one or both ends; it may contain portions with elliptical cross sections and other portions with polygonal cross sections; or it may contain portions with geometric cross sections, and other portions with nongeometric cross sections. These examples of cross section shapes are meant to be illustrative, and not limiting.

FIG. 1 also features a directional marking 7 running the length of the sighting element 1. The directional marking further aids the golfer in visually lining up his shot. While the directional marking 7 preferably consists of a solid line as is shown in FIG. 1, other suitable markings may be used, such as multiple solid lines or a broken line.

As FIG. 1 illustrates, the invention may be presented as a kit in which the magnet 4 is permanently affixed to the base 3 of the device 20, or in which glue 19 is provided for permanently attaching the magnet 4 to the base 3 of the device 20, or in which the magnet has a pressure-sensitive adhesive backing suitable for attaching it to the base 3. The kit also contains congruent strips of a hook and loop type fastener 5. One of these strips may be attached by glue 19 or by a pressure sensitive adhesive backing to either the base 3 or the magnet 4. The other strip may be similarly attached to the head of the club. When these strips are pressed together, the device 20 is removably affixed to the head of the club. Other kits containing these or other suitable means of attachment are possible.

It is to be understood that the term "hook and loop type fastener" as used here refers to any material having complemental parts which adhere to each other when pressed together, whether or not those complemental parts actually contain hooks and loops. Hence the term contemplates, but is not limited to, materials sold under the Velcro ® brand name.

The present invention may also be presented as a kit for permanently affixing the training device to a golf club. Any known method appropriate for permanently affixing the device to a golf club may be used, e.g., glue 19.

FIG. 2 illustrates the directional guidance that the invention provides to a golfer. The dashed line 15 indicates the imaginary line along which the sighting element of the device tells a golfer 16 to align his club, during both the backward and forward swings, to impart to the golf ball 9 a velocity in the direction in which the sighting element is pointed.

FIG. 3 shows a side view of the device 20 attached to a putter. The sighting element 1 is maintained at a fixed vertical incline from the base of the device 3 by a rigid arm 2. Though the preferred embodiment contemplates attachment of the device to the head 13 of a club, the present invention also contemplates attachment of the device to the shaft 12 of a club.

As FIG. 3 also shows, the sighting element 1 of the device extends over both the hitting face 10 and back face 11 of the head 13 of the club. The portion of the sighting element 1 which extends over the hitting face 10 of the head 13 of the club aids the golfer in aligning his shot, while the portion extending over the back face 11 of the head 13 of the club aids the golfer in visualizing his stroke. Together, these features enable a golfer to effectively visualize his stroke and the path of the ball.

FIG. 4 is a top plan view of the device 20 mounted on a golf club. The relatively thin rod-like sighting element 1, which may be made out of plastic, metal, wood, or any other suitable material, extends over the hitting face 10 and back 11 face of the club, thereby indicating the line along which the club should be swung and the ball should be hit. Base 3 is preferably secured to the head of the club 13 by a magnet or a hook and loop type fastener. However, any other suitable means for removably fixing the device to a golf club may be used.

In the preferred embodiment, the sighting element 1 extends over and beyond the golf ball 9 to provide optimum directional guidance; however, any length of extension in this direction which provides suitable directional guidance may be used. Though the sighting element 1 is essentially straight in the preferred embodiment, the invention contemplates other useful configurations, including, but not limited to, embodiments where the sighting element is slightly bent or curved. Though FIG. 4 illustrates the use of the device 20 with a putter, the device of the present invention is capable of being removably attached to, and may be used in conjunction with, putters, woods, irons, and any other types of golf club.

FIG. 5 shows a side view of an embodiment of the device 20 in which a magnet 4 is used to affix the device to the head 13′ of a golf club. FIG. 5 also illustrates the use of the device 20 with a club having a head 13′ of roughly rectangular cross section.

Figure 6:
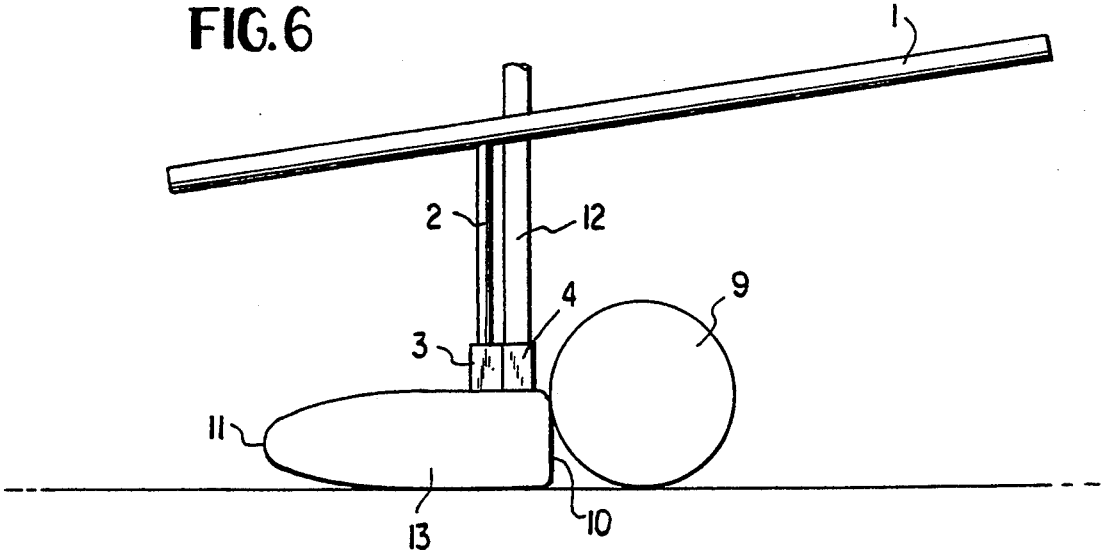
FIG. 6 is similar to FIG. 5, but illustrates the use of the device of FIG. 1 on a club with a rounded head.

FIG. 6 is similar to FIG. 5, except that FIG. 6 shows the use of the device 20 with a club having a head 13″ that is rounded. Here, the base 3 of the device is affixed to the top of the head 13″ of the club by a magnet 4.

Figure 7:
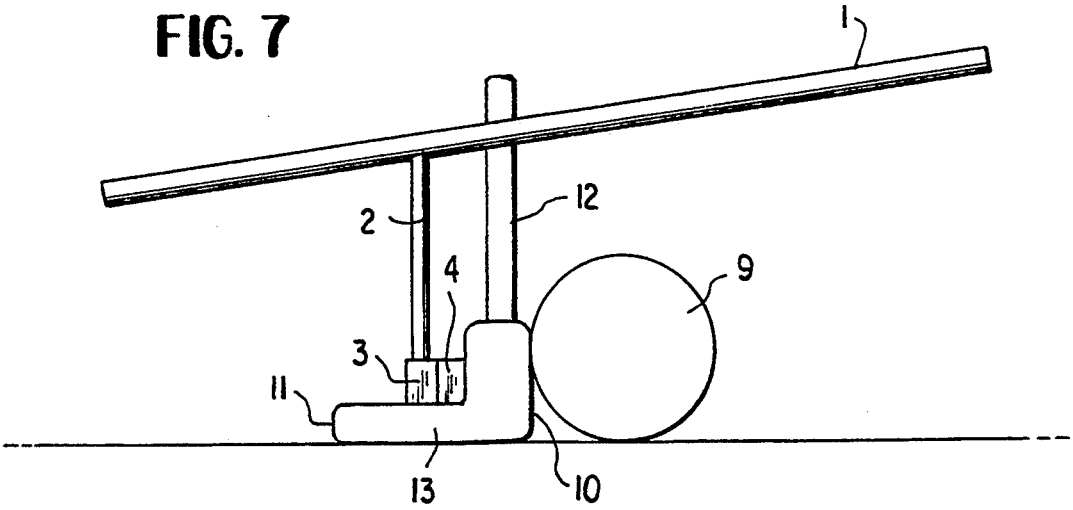
FIG. 7 is similar to FIG. 6, but illustrates the use of the device of FIG. 1 with a club head that has a flattened bottom which intersects the hitting face at approximately a 90 degree angle.

FIG. 7 illustrates the use of the device 20 with a club having a head 13‴ consisting of a flat bottom portion which intersects the hitting face 10‴ of the club at approximately a 90 degree angle. The base 3 of the device is secured by a magnet 4 or some other attaching means to the back of the hitting face 10‴, in such a way that the base 3 of the device rests against the flat portion of the head 13‴ of the club. At least part of the attaching means is secured, by glue or some other suitable adhesive, to a face of the base 3 of the device. When the attaching means is a magnet 4, it is preferred that one face of the magnet 4 is glued to the base 3 of the device 20. However, other suitable arrangements are possible. When the attaching means is a hook and loop type fastener, it is preferred that one strip of the material is glued, or affixed with a pressure sensitive adhesive backing, to the base 3 or magnet 4, and that another strip is similarly affixed to the head of the golf club 13‴. However, other suitable arrangements are possible.

FIG. 8 shows a side view of a package 30 for providing a golf training device kit. Other packaging may be suitable.

In the preferred embodiment of the invention, the arm and sighting element are constructed out of a dull black plastic, and the sighting element is cylindrical with a bright white line running along its entire length. The sighting element slants in an upward incline in the direction in which the ball is to be hit. The angle of incline relative to the arm is about 98 degrees. The segment of the sighting element which extends over the hitting face of the head of the club from the point at which the arm is attached is a little less than 18 cm. This is slightly less than twice the length of the segment extending over the back face of the head of the club from the point at which the arm is attached. The arm is approximately 6 cm in length and bisects a rectangular base. The longest dimension of the base is about 6 cm and is perpendicular to the line of the sighting element.

Of course, the arm of the sighting element may be located anywhere along the length of the sighting element, so long as the sighting element extends over both the front and back of the head of the golf club. Furthermore, while the shaft of the sighting element is preferably cylindrical in shape, other useful shapes are contemplated.

I claim:

1. A removable training device for use in conjunction with a golf club having a head with a front face for hitting a ball and a rear portion situated opposite of the front face, said device comprising:

an elongated sighting element;

vertically oriented support means for supporting said sighting element on the head of a golf club in such a way that, when the club head is resting on a flat surface in a normal upright golf ball putting position, said support means engages said head, and said sighting element extends above the head of the club at an upward inclination with respect to the support means and the flat surface and with a first portion of said sighting element extending beyond the front face of the head of the club and a second portion of said sighting element extending beyond the rear portion of the head of the club; and attaching means for attaching said support means to the head of a golf club.

2. The device of claim 1, wherein said sighting element has at least one directional marking along its length.

3. The device of claim 1, wherein the angle of said upward incline between the sighting element and the vertical support means is within the range of 91–135 degrees.

4. The device of claim 3, wherein the angle of upward incline is 98 degrees.

5. The device of claim 1, wherein said means of attachment is at least one magnet.

6. The device of claim 1, wherein said means of attachment is a hook and loop type fastener.

7. The device of claim 1, wherein the angle of inclination of the sighting element, the length of said first portion of said sighting element, and the length of said second portion of said sighting element are such that the sighting element does not come into contact with the ground or the ball when the club is swung.

8. A kit for constructing a removable training device for use in conjunction with a golf club having a head with a front face for hitting a ball and a rear portion situated opposite of the front face, said kit comprising:

an elongated sighting element;

vertically oriented support means for supporting said sighting element on the head of a golf club in such a way that, when the club head is resting on a flat surface in a normal upright golf ball putting position, said support means engages said head, and said sighting element extends above the head of the club at an upward inclination with respect to the support means and the flat surface and with a first portion of said sighting element extending beyond the front face of the head of the club and a second portion of said sighting element extending beyond the rear portion of the head of the club;

first attaching means for removably attaching said sighting element to a golf club head;

second attaching means for removably attaching said sighting element to a golf club head; and packaging means for containing said sighting element and said first and second means for removably attaching the sighting element to a golf club head.

9. The kit of claim 8, wherein said sighting element has at least one directional marking along its length.

10. The kit of claim 8, wherein the first means for removably attaching the sighting element to a golf club is a hook and loop type fastener and the second means for removably attaching the sighting element to a golf club is a magnet.

* * * * *